US006116129A

United States Patent [19]

Takayama et al.

[11] Patent Number: 6,116,129

[45] **Date of Patent: *Sep. 12, 2000**

[54] TAPE END TRIMMING APPARATUS

[75] Inventors: Masaji Takayama, Suwa; Kenji Watanabe, Tokyo; Takanobu Kameda, Tokyo; Chieko Aida, Tokyo; Tomoyuki Shimmura, Tokyo, all of Japan

[73] Assignee: Seiko Epson Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/565,290

[22] Filed: Nov. 30, 1995

[30] Foreign Application Priority Data

Dec. 2, 1994 [JP] Japan ..... 6-299601
Nov. 10, 1995 [JP] Japan ..... 7-292818

[51] Int. Cl.[7] ..... B26D 5/28

[52] U.S. Cl. ..... 83/211; 83/372; 83/444; 83/603; 83/607; 83/468.1; 83/468.94; 83/694; 83/856; 400/621

[58] Field of Search ..... 83/659, 663, 607, 83/603, 63, 372, 444, 686, 869, 633, 467.1, 468.1, 468.93, 468.94, 203, 211, 212, 364, 694, 856, 67; 30/229; 79/24.5; 400/621, 621.1

[56] References Cited

U.S. PATENT DOCUMENTS

| | | | |
|---|---|---|---|
| 642,540 | 1/1900 | Tousignant et al. | 83/603 |
| 2,163,868 | 6/1939 | Christie | 83/468.93 |
| 3,146,651 | 9/1964 | Busk . | |
| 3,237,494 | 3/1966 | Norvelle | 83/862 |
| 3,552,253 | 1/1971 | MacDonald | 83/372 X |
| 3,998,118 | 12/1976 | Brophy et al. | 83/372 X |
| 4,108,034 | 8/1978 | Thomas | 83/372 X |
| 4,227,305 | 10/1980 | Newman . | |
| 4,442,743 | 4/1984 | Szanto | 83/372 X |
| 4,611,519 | 9/1986 | Hagerty | 83/389 |
| 4,807,363 | 2/1989 | Clifton, Jr. | 30/229 X |
| 4,876,795 | 10/1989 | Chun-Cheng | 30/229 X |
| 4,987,811 | 1/1991 | Ikarashi et al. | 83/372 X |
| 5,063,803 | 11/1991 | Panneri et al. | 83/203 |
| 5,095,792 | 3/1992 | Moody | 83/444 X |
| 5,174,670 | 12/1992 | Takagi et al. | 400/621 |
| 5,193,427 | 3/1993 | Johannsen | 83/607 X |
| 5,224,786 | 7/1993 | Takagi et al. | 400/621 |
| 5,271,789 | 12/1993 | Takagi et al. | 400/621 X |
| 5,595,447 | 1/1997 | Takayama et al. | 400/231 |
| 5,599,119 | 2/1997 | Nunokawa et al. | 400/621 |
| 5,605,404 | 2/1997 | Nunokawa et al. | 400/208 |
| 5,823,694 | 10/1998 | Ikegami | 400/621 |
| 5,937,725 | 8/1999 | Kamijo et al. | 83/880 |

FOREIGN PATENT DOCUMENTS

| | | | |
|---|---|---|---|
| 0 449 465 | 10/1991 | European Pat. Off. . | |
| 40 07 538 | 9/1991 | Germany . | |
| 3-287397 | 12/1991 | Japan . | |
| 372831 | 12/1963 | Switzerland | 83/372 |

*Primary Examiner*—M. Rachuba
*Assistant Examiner*—Boyer Ashley
*Attorney, Agent, or Firm*—Hogan & Hartson, LLP

[57] ABSTRACT

A tape end trimming apparatus for appropriately cutting and shaping the ends of plural tapes of different widths without wasting the tape and without requiring replacement of the cutting blade is provided. The tape end trimming apparatus comprises cutting for trimming the corners of the end member of a tape. A guide member comprises tape insertion path for guiding an inserted tape to the cutting apparatus. An end position regulator regulates the insertion position of the tape end. The cutting apparatus comprises cutting blade for cutting the end corners at the sides of tape with the position of one side thereof regulated by one tape side position regulator and the position of the end thereof regulated by end position regulator, and the position of the other side thereof regulated by the other tape side position regulator and the position of the end thereof regulated by end position regulator.

23 Claims, 7 Drawing Sheets

TAPE END TRIMMING APPARATUS

BACKGROUND OF THE INVENTION

1. Field of the Invention

The present invention relates to a tape end trimmer for cutting the corners of the ends of a printed label-like tape in a radius or other shape.

2. Description of the Related Art

Tape printing apparatus are commonly used to print letters and/or graphic on a blank tape. The blank tape is fed to the tape printing apparatus, and the printed tape is cut and then trimmed by a tape end trimmer. One type of conventional tape end trimmer known is utilized in the tape printing apparatus and described in Japanese TOKKAI H3-287397 (1991-287397). This type of tape printing apparatus comprises a trimmer for the specific width of the tape to be cut, and requires the trimmer to be changed each time a tape having different width is used. The trimmer comprises a cutter unit for trimming the tape end, and a guide member for guiding the inserted tape to the cutter unit. When printing is completed, the tape fed out from the tape printing apparatus is inserted to the trimmer, and the end of the tape is cut automatically by the trimmer.

Trimming the tape end by the cutter unit is accomplished in this case by the cutter unit simultaneously cutting both corners of the tape end and the edge connecting those corners. More specifically, the end of the tape is cut to a known dimension so that the corners of the resulting tape end are curved.

This type of conventional tape end trimmer, however, simultaneously cuts not only the corners of the tape end, but the edge member connecting those corners, i.e., cuts the tape end to a constant dimension. The overall length of the tape is therefore shortened by the amount cut off, and a long blank (unprinted) space at the tape end must be reserved to prevent the printed area from being cut off. This results in excessive tape waste.

Furthermore, the trimmer itself must be manufactured according to the tape width, and cannot be used to cut tapes of any other width. With a tape printing apparatus of this type, therefore, it is necessary to have plural trimmers to print and cut tapes of different widths, thus making the tape trimming operation more complex and cumbersome.

OBJECTS OF THE INVENTION

Therefore it is an object of the present invention to obviate the aforementioned problems associated with convention tape and trimmers.

It is another object of the present invention to provide a tape end trimmer for appropriately cutting and shaping the ends of plural tapes having different widths without wasting excessive amount of tape and without requiring replacement of the cutting blade according to the tape width.

It is a further object of the present invention to provide a tape end trimmer for cutting and shaping tapes of plural different widths using a single cutting blade without wasting tape and with an appropriate and simple operation.

It is an additional object of the present invention to provide a tape end trimmer which can be built compactly even when the apparatus can handle wide tapes.

It is still another object of the present invention to provide a tape end trimmer having a single cutting blade for trimming, tapes of different widths which can be appropriately cut and shaped by simply inserting the tape.

SUMMARY OF THE INVENTION

In accordance with an aspect of the present invention, a tape end trimming apparatus comprises a cutting means for cutting first and second corners of a tape end to a known or predetermined shape. A guide means is disposed in proximity to a cutting means and comprises an insertion path for guiding the inserted tape to the cutting means. An end position regulating means regulates the insertion position of the end of the tape inserted to the insertion path; and first and second side position regulating means regulates the insertion positions of first and second sides of the tape inserted into the insertion path. The cutting means further comprises a cutting blade for trimming the corner of the first side of the tape end with the position of the first side of the tape regulated by the first side position regulating means and the position of the tape end regulated by the end position regulating means, and for trimming the corner of the second tape side with the position of the second side of the tape regulated by the second side position regulating means and the position of the end thereof regulated by the end position regulating means.

By means of this embodiment, the insertion position of the tape is regulated by the end position regulating means when the tape is inserted to the insertion path with one side regulated by one of the side position regulating means. More specifically, when the cutting blade of the cutting means is operated to cut the tape with one side of the tape positioned by the one side position regulating means and the end of the tape positioned by the end position regulating means, one end corner of the tape is cut to shape. When the tape is then removed and reinserted with the other side of the tape positioned by the other side position regulating means, or is simply moved horizontally to position the other side of the tape to the other side position regulating means without completely removing the tape from the insertion path, and the cutting blade of the cutting means is again operated, the other end corner of the tape is cut to shape. By thus using both sides and the end of the tape to position the tape, and then operating the cutting means, both corners of the tape end can be cut to the desired shape using a single cutting blade irrespective of the actual tape width.

In the tape end trimming apparatus described above, the pair of side position regulating means is preferably a pair of passage walls forming an insertion path with said pair of passage walls parallel to each other.

With this configuration, the tape can be easily positioned for cutting the other corner by simply moving the tape horizontally to the other parallel side after cutting the first corner.

In accordance with another aspect of the present invention, the distance between the pair of passage walls preferably matches the width of the tape of the greatest width that may be shaped and cut.

With this configuration, both sides of the tape of the greatest insertable width can be automatically positioned at the same time by simply inserting the tape to the insertion path guided by the path walls, i.e. by simply inserting the tape, and both corners can be simultaneously cut with a single cutting action.

In accordance with an additional aspect of the present invention, the cutting blade preferably cuts each of the tape corners to a known curved shape, and the contour of the edge of the cutting blades for the tape corners preferably comprises a curved part with a central angle from fifty to seventy degrees and linear parts extending from the ends of the curve in the respective tangential directions.

As a result of this arrangement, the central angle of the curve is smaller the ninety degrees with this configuration, the sides and end of the tape are cut at an angle by the part of the cutting blade forming the tangential lines. Accordingly, the cut ends are cut cleanly, and the corners can be accurately cut to a curved shape even without the tape being accurately positioned. Furthermore, because the central angle of the curve is from fifty to seventy degrees, the cut end is not visually inferior when compared with a curved shape having a precise ninety degree central angle, and a pleasing cut finish can be obtained.

In accordance with a further aspect of the present invention, the cutting blade preferably comprises a fixed blade and a moving blade for cutting the tape by means of a relative cutting action, and the fixed blade is preferably disposed to the guide means.

The tape is therefore cut by means of a pressure cutting action with pressure applied from both front and back sides of the tape. Cutting resistance is therefore low, and the tape can be cut with a relatively low cutting force. Furthermore, because the fixed blade is disposed to the guide means, the tape corners can be consistently cut to a constant, accurate shape by positioning the tape corners to the cutting edge of the fixed blade.

In accordance with still another aspect of the present invention, the fixed blade and moving blade are preferably integrally shaped with a plate-like blade forming the respective cutting edges, and a plate-like blade holder perpendicular to said blade.

Because the plate-like blades forming the cutting edges of the fixed and moving blades are formed perpendicularly to and integrally with the respective plate-like blade holders, the fixed and moving blades can be formed by bending a sheet material, and the rigidity of both can be improved.

In accordance with still an additional aspect of the present invention, the blade of the fixed blade is preferably disposed near to the passage surface of the insertion path with a gap therebetween allowing insertion of the tape. By means of this configuration, the member pressing on the end of the inserted tape can be formed to incorporate the cutting blade of the fixed blade.

In accordance with still a further aspect of the present invention, the gap between the blade of the fixed blade and the passage surface of the insertion path preferably narrows from the outside insertion opening side to the inside end of the insertion path.

Even when the end of the tape is curled, this configuration makes it difficult for the cutting blade of the fixed blade to obstruct insertion of the tape, effectively straightens any curling in the fully inserted tape, and introduces the leading edge of the tape to the cutting blade in a flattened state. Narrowing of the insertion path also prevents insertion of tape which is too thick for the cutting blades to cut because the tape will bind in the insertion path before the blade.

In accordance with yet another aspect of the present invention, the cutting operation is preferably accomplished by means of the moving blade rotating relative to the fixed blade. The cutting operation can thus be accomplished using the moving blade as a lever, and the structure of the cutting means can thus be simplified.

In accordance with yet an additional aspect of the present invention, the cutting blade preferably comprises a shaft member supporting the moving blade in a freely rotating manner with said shaft member fixed to the fixed blade. The tape can therefore be cut using a scissors-like cutting operation in which the one cutting blade is fixed, and the moving blade can be assembled with good precision relative to the fixed blade. Furthermore, the shaft member positions the fixed blade to the moving blade with good precision, and the fixed blade can be assembled to the guide means while thus assembled.

In accordance with yet a further aspect of the present invention, the cutting edge of the moving blade contacts the edge of the fixed blade at an angle to the cutting direction when cutting the tape.

The tape is thus cut by means of a three-dimensional cutting action, i.e., the contact point of the cutting edge of the moving blade moves along the cutting edge of the fixed blade during the cutting operation. As a result, the cutting resistance is low, and the tape can be appropriately cut with little force.

In accordance with still yet another aspect of the present invention, the cutting edge of the fixed blade and the cutting edge of the moving blade each preferably project into the direction of the cutting operation. As a result, the shape of the cutting edges is retained and the cutting ability does not deteriorate even after the cutting edges of the fixed and moving blades wear as a result of repeated cutting operations.

In accordance with still yet an additional aspect of the present invention, the hardness of the cutting edge of the fixed blade is greater than the hardness of the cutting edge of the moving blade. When the cutting operation is repeated many times with this configuration, the cutting edge of the moving blade wears more rapidly than does the cutting edge of the fixed blade, and the fixed blade retains is original shape. As a result, if the tape is positioned to the cutting edge of the fixed blade, the cutting position of the tape will not change as a result of wear to the cutting edge.

In accordance with still yet a further aspect of the present invention, the cutting edge of the fixed blade and the cutting edge of the moving blade are each continuously formed to include parts for cutting both corners of the tape. The parts are preferably in constant mutual contact, and the moving blade is pressed toward the fixed blade, within the turning range of the moving blade.

When the cutting edge of the moving blade wears with this configuration, a gap does not occur between the fixed and moving blades, and a good cutting edge can be maintained for an extended period of time.

In accordance with another aspect of the present invention, the cutting means preferably comprises a drive apparatus for driving the cutting operation of the moving blade. It is thereby possible to automatically cut and shape the end of the inserted tape.

In accordance with an additional aspect of the present invention, a detection means detects insertion of the tape to the insertion path, and a control means drives the drive apparatus based on the detection signal output from the detection means.

By means of this configuration, the cutting operation of the moving blade is executed to automatically cut and shape the tape corners when the tape is simple inserted to the insertion path. In addition, the cutting operation of the moving blade terminates automatically when the tape is removed from the insertion path.

In accordance with a further aspect of the present invention, the detection means preferably continuously detects whether the tape is inserted to the insertion path. As a result, the cutting operation of the moving blade is performed for as long as the tape is inserted to the insertion path. It is therefore possible for the tape to be cut while it is being positioned, and the tape corners can be reliably cut to the desired shape. In addition, the tape will be reliably cut irrespective of where the cutting start position of the moving blade is located. More specifically, it is not necessary to control the stop position of the moving blade.

In accordance with still another aspect of the present invention, the control means comprises a timer, and preferably overrides the detection signal to stop the drive apparatus when a predetermined period of time has elapsed from the start of detection signal input. As a result, the cutting operation of the moving blade is sustained i.e., is repeatedly executed, when the tape is inserted, but stop automatically if the tape is not removed after being cut and a predetermined period of time elapses. This effectively suppresses unnecessary operation of the moving blade.

In accordance with still a further aspect of the present invention, the detection means is preferably disposed before the end position regulating means in the tape insertion direction. As a result, the cutting operation of the moving blade starts before the tape end reaches the end position regulating means. The tape can therefore be cut and shaped quickly, and the tape corners can be gradually cut to the particular curved shape. The placement of the detection means also prevents the tape end from being obstructed by the stopped moving blade before it reaches the end position regulating means.

In accordance with yet another aspect of the present invention, the detection means is preferably a mechanically operating detection switch with the detector end thereof projecting into the insertion path. Detection errors or non-detection by the detection means caused by dust, lint, or other foreign matter can thus be prevented, and tape insertion can be reliably detected.

In accordance with yet an additional aspect of the present invention, the detection switch preferably comprises a switch arm and a switch body. The switch arm rotates freely between a non-detection position whereat the one detecting end of said switch arm projects into the insertion path, and a detection position whereat said detecting end is retracted from the insertion path. The switch body is in contact with the other end of the switch arm and switches on-off as the switch arm moves between the non-detection position and the detection position. With this configuration, the switch arm will not interfere with insertion of the tape, and the switch body can be positioned with a greater degree of freedom.

In accordance with yet a further aspect of the present invention, the detecting end of the switch arm is preferably a pair of detector projections, each facing the insertion path, and disposed perpendicularly to the insertion direction.

By virtue of this feature it is therefore not necessary to increase the size of the detecting end of the switch arm as a means of improving detection precision, and it is also not necessary to provide a large hole for the detecting end of the switch arm in the guide means forming the insertion path. In addition, both detector projections can operate under identical detection conditions.

In accordance with still yet another aspect of the present invention, the detector projections are preferably provided such that at least one of the detector projections rotates and operates when the narrowest tape that may be trimmed is inserted at any point in the width direction of the insertion path.

With this configuration, the detector projections can reliably detect tape insertion and accomplish the cutting operation irrespective of where in the insertion path a tape of the narrowest usable width is inserted. As a result, moving the tape sideways for positioning after insertion to the insertion path will not interfere with tape cutting. Furthermore, if the tape is moved sideways to cut the second corner after cutting the first corner, the cutting blades will not stop operating and tape cutting can be continuously accomplished.

In accordance with still yet another aspect of the present invention, the cutting means preferably comprises a presser blade for pressing against and cutting the tape from the vertical direction, and a cutter bar against which the cutting edge of the presser blade presses vertically. Furthermore, the cutter bar is preferably disposed as an extension of the insertion path.

It is therefore possible by means of this configuration to only partially cut the tape by appropriately adjusting the cutting depth of the presser blade. More specifically, when the tape comprises an adhesive-backed tape and a backing paper to be removed for applying the tape to some object, it is possible to cut only the adhesive-backed tape part of said tape, and the tape can thus be both cut to the desired shape and processed to facilitate separation of the adhesive-backed tape and the backing paper.

In accordance with still yet a further aspect of the present invention, a cutting means is provided for cutting the corners of a tape end to a known shape and guide means is disposed in proximity to the cutting means, comprising an insertion path for guiding the inserted tape to the cutting means. An end position regulating means regulates the insertion position of the end of the tape inserted to the insertion paths, and a pair of side position regulating means regulates the insertion positions of both sides of the tape inserted to the insertion path. The cutting means comprises a first cutting blade for trimming the corner of one side of the tape end with the position of the side of the tape regulated by one side position regulating means and the position of the tape end regulated by the end position regulating means, and a second cutting blade for trimming the corner of the other tape side with the position of the other side of the tape regulated by the other side position regulating means and the position of the end thereof regulated by the end position regulating means.

The first and second corners of the tape end are thus separately cut by the first and second cutting blades, enabling a more compact construction around the cutting blades, and making it possible to prevent a cutting apparatus usable with wide tapes from becoming overly large.

In accordance with another aspect of the present invention, a cutting means is provided for cutting the corners of a tape end to a known shape. A guide means is disposed in proximity to the cutting means and comprising an insertion path for guiding the inserted tape to the cutting means. An end position regulating means regulates the insertion position of the end of the tape inserted to the insertion path. The guide means comprises a path width adjusting mechanism for adjusting the width of the insertion path referenced to the center line of the insertion path according to the width of the tape to be cut. The end position regulating means comprises a regulated position adjusting mechanism for regulating the insertion position in stages according to the width of the tape to be cut with the position for a narrow tape forward in the insertion direction from the position for a wide tape. The cutting means comprises a cutting blade with the cutting edge thereof shaped in symmetrical stages corresponding to the corner positions of the tapes of the usable tape widths when the tapes are inserted and positioned to the corresponding regulated positions.

When the tape is inserted to the insertion path after adjusting the path width adjusting mechanism to the width of the tape to be cut with this configuration, the tape is controlled to the insertion position appropriate to that tape width by the regulated position adjusting mechanism. As a result, the tape end is appropriately positioned, and when the cutting blade is operated, one part of the cutting edge of the cutting blade simultaneously cuts and shapes both corners of the tape. By thus enabling the width of the insertion path to be adjusted for various tape widths, and shaping the cutting blade to simultaneously cut both corners of tapes of different widths, it is possible to appropriately cut and shape tapes of different widths using a single cutting blade.

In accordance with an additional aspect of the present invention, a cutting means is provided for cutting the corners of a tape end to a known shape, and a guide means is disposed in proximity to the cutting means for guiding the inserted tape to the cutting means. An end position regulating means regulates the insertion position of the end of the tape inserted to the insertion path. The guide means comprises plural insertion paths each having a width corresponding to one of plural usable tape widths and disposed in a stacked vertical arrangement. The end position regulating means comprises a regulated position adjusting mechanism for regulating the insertion position in stages according to the width of the tape to be cut with the position for a narrow tape forward in the insertion direction from the position for a wide tape. The cutting means comprises a cutting blade with the cutting edge thereof symmetrically shaped in stages corresponding to the corner positions of the tapes of the usable tape widths when said tapes are inserted and positioned to the corresponding regulated positions.

When a tape is inserted to the insertion path of the matching width in an apparatus of this configuration, the tape is controlled to the insertion position matching that tape width by the regulated position adjusting mechanism. As a result, the tape end is appropriately positioned, and when the cutting blade is operated, one part of the cutting edge of the cutting blade simultaneously cuts and shapes both corners of the tape. By thus providing plural insertion paths according to the various tape widths that may be used, and shaping the cutting blade to simultaneously cut both corners of tapes of different widths, it is possible to appropriately cut and shape tapes of different widths using a single cutting blade.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

DESCRIPTION OF THE PREFERRED EMBODIMENTS

The preferred embodiments of a tape end trimming apparatus according to the present invention is described hereinbelow with reference to the accompanying figures as applied to a tape printing apparatus. As noted above the tape printing apparatus is used on print letters and/or graphics to a blank tape, and then to cut the printed tape to a predetermined dimension to form labels. The tape end trimming apparatus then cuts and shapes the corners of the ends of this tape label to a particular curved shape.

Figure 1:
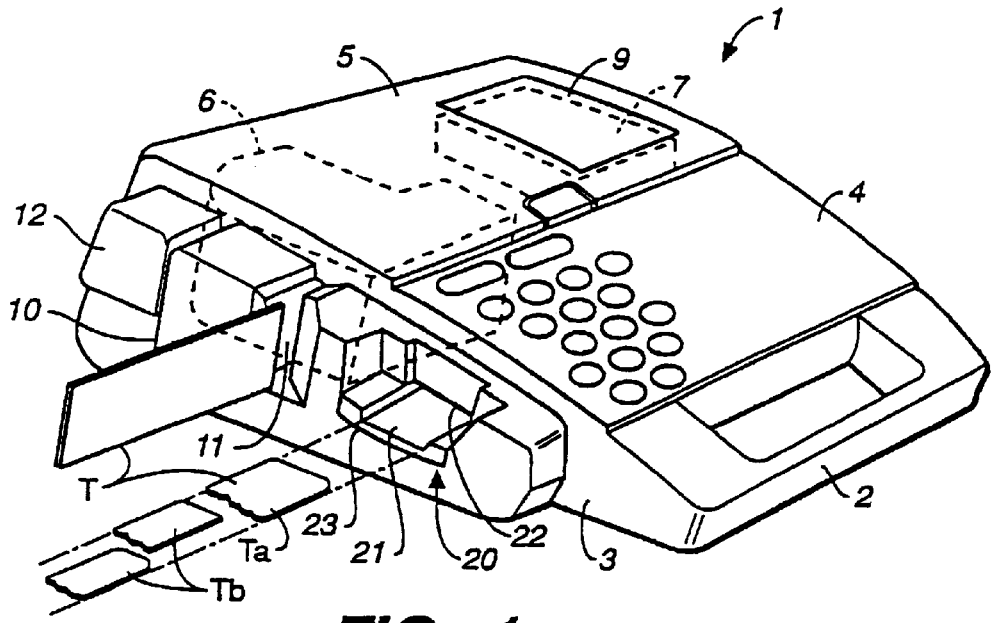
FIG. 1 is an overview of a tape printing apparatus equipped with a tape end trimming apparatus in accordance with the present invention.

An example of a tape printer 1 is shown in FIG. 1. Tape printer 1 comprises case 3 having grip 2 formed at the front thereof. Keyboard 4 is provided in the front half of case 3, the back half of which is enclosed by cover 5, which can be opened and closed. Tape cartridge 6, a printing mechanism (not shown in the figure), and display 7 are exposed by opening cover 5 to expose the inside of case 3.

Typically the user inputs the letters to be printed using keyboard 4 while viewing the text on display 7 through window 9, and presses a print key on keyboard 4 after confirming the input text to print to the tape. When the print key is pressed, the printer mechanism feeds tape T from tape cartridge 6 and prints and feeds the printed tape T out from case 3.

Secondary case 10 is disposed at the side of case 3, and comprises tape opening 11 through which the fed tape T passes. Cutter button 12 is provided in secondary case 10 behind tape opening 11. When printing is completed, the tape T being fed through tape opening 11 stops. If cutter button 12 is then pressed, the tape cutter is operated via a link (neither being shown in the figures), and the end of tape T is cut square near tape opening 11.

Also disposed in secondary case 10 in front of tape opening 11 are tape insertion path 21 of tape end trimming apparatus 20 forming the essential component of the present invention, and tape insertion opening 22 adjoining tape insertion path 21. Tape Ta in FIG. 1 indicates the maximum tape width that can inserted in tape insertion opening 22. When the end of maximum-width tape Ta is inserted in tape insertion opening 22, both corners of the leading edge of tape Ta are cut to the defined shape, such as a curved shape. Tape Tb in FIG. 1 indicates a tape having a width narrower than the maximum width Ta that can also be inserted in tape insertion opening 22. When the end of tape Tb is inserted in tape insertion opening 22, only one corner is cut to shape each time the tape Tb is inserted.

The tape T used in this embodiment is an adhesive film tape with a backing paper. The tape printer prints only to the front of the adhesive film tape. This tape is applied to the desired object after cutting all four corners of the tape to shape and removing the backing paper. Tape T may also be available in various widths, e.g., 24 mm, 18 mm, 12 mm, and 9 mm, in which case plural tape cartridges 6 holding blank tapes of the same widths (24 mm, 18 mm, 12 mm, and 9 mm) are also available. In other words, a separate tape cartridge 6 is provided for each usable tape width, and to print a tape of a specific width the user must install a tape cartridge containing that width of tape.

First Embodiment

Figure 2:
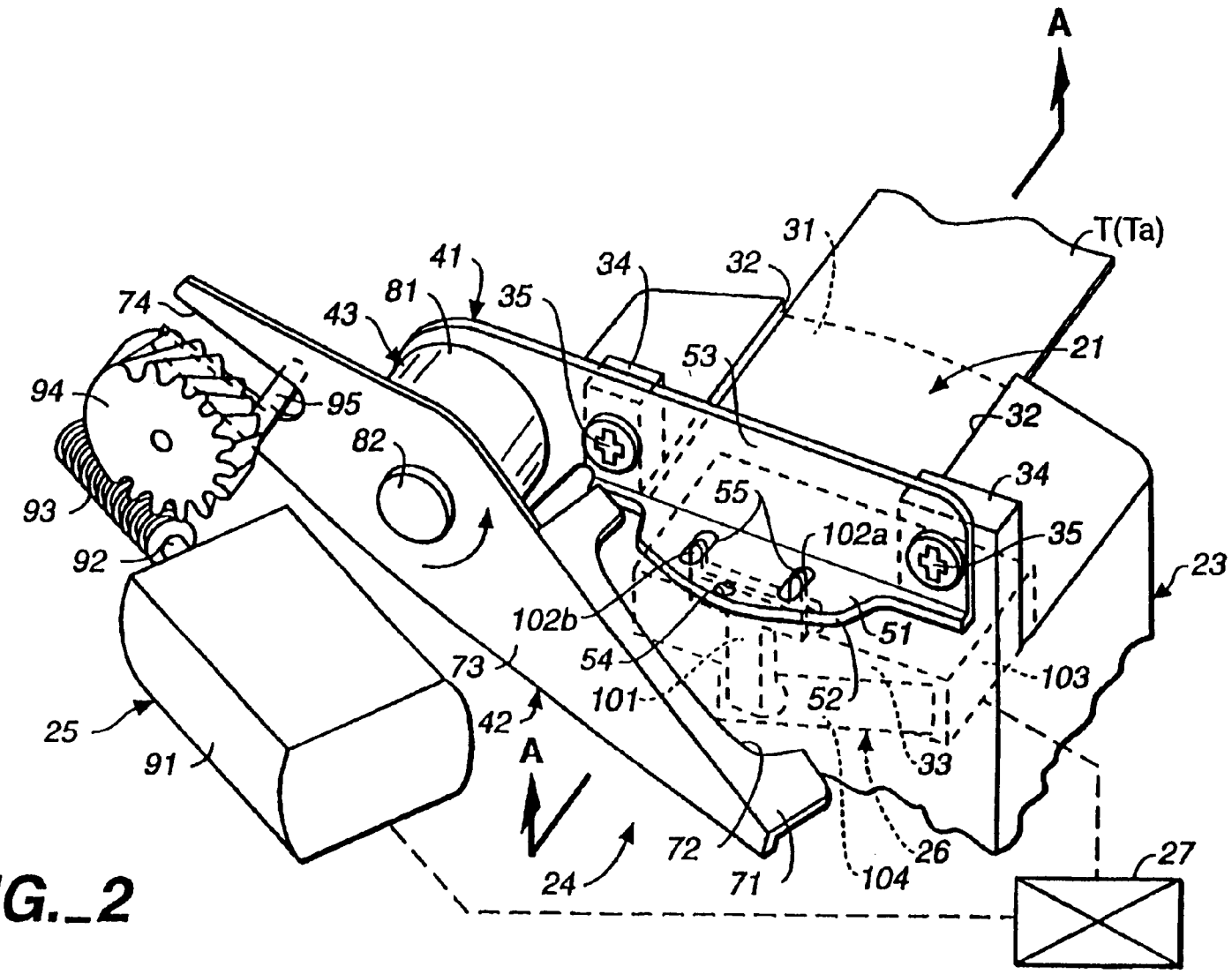
FIG. 2 is an exploded perspective view of the tape end trimming apparatus in accordance with a first embodiment of the present invention.

Tape end trimming apparatus 20 is described in detail below with reference to FIG. 2. As shown in FIG. 2, tape end trimming apparatus 20 comprises guide means 23 forming tape insertion path 21 and tape insertion opening 22; cutting blade 24 provided at the end of guide means 23; and drive apparatus 25 for operating cutting blade 24. Detection means 26 for detecting insertion of tape T to tape insertion path 21 is provided in guide means 23, and is connected to control means 27 of drive apparatus 25. In this case, guide means 23 is disposed on the outside of the tape end trimming apparatus (FIG. 1), and the other components are built in to case 3.

Guide means 23 is disposed to fit from the side of case 3 into secondary case 10 projecting at the side of case 3 (FIG. 1), and comprises on the top thereof a shallow channel-like tape insertion path 21, which is formed by passage surface 31 and a pair of side walls 32. The pair of side walls 32 rise substantially perpendicular from the flat passage surface 31, and are formed parallel to each other with a gap therebetween set according to the maximum width (24 mm in this example) of tape Ta. Side walls 32 together form the guide members guiding the sides of the inserted tape T, and thus form the side position regulating means controlling the positions of the sides of the tape T for cutting. Note that in this example the gap between the sides of tape insertion path 21 is 24.1 mm to accommodate a maximum tape Ta width of 24 mm.

By inserting the maximum width tape Ta with both sides guided by the pair of side walls 32 (i.e., simply inserting the tape to tape insertion path 21), both corners at the leading edge of tape Ta are cut to the desired shape. When a tape of narrower width Tb (18 mm, 12 mm, or 9 mm in this case) is inserted with one side thereof guided by one of the side walls 32, only the one leading corner of tape Tb is cut to shape; the other leading corner is then cut by inserting the tape Tb with the side of the uncut corner guided by the other side wall 32. It is to be noted that it is also possible to simply insert tape Tb to tape insertion path 21, then slide it horizontally to the one side wall 32 to cut the one corner, and then slide it horizontally to the other side wall 32 to cut the other corner. It is also possible to insert tape Tb with one side thereof guided by one side wall 32, cut the corner, and then slide the tape Tb to the other side wall 32 to cut the other corner.

A pair of supports 34 is also provided in a vertical orientation on opposing sides of tape insertion path 21 at end 33 of guide means 23 at the side of case 3. Fixed blade 41 of cutting blade 24, described below, is fastened using a pair of set screws 35 to this pair of supports 34. In this position, blade 51 of fixed blade 41, described below, covers the end of tape insertion path 21 from above. More specifically, end 33 of guide means 23 forming the end of tape insertion path 21 is set back slightly from blade 51 of fixed blade 41, and projects conforming to the shape of the edge of blade 51. A crescent-shaped stopper 36, or end position regulating means, projects upward at the top of this shaped end 33 of guide means 23. Positioning pin 37 projects at the top of stopper 36. Blade 51 of fixed blade 41 is fit to this positioning pin 37, and fixed blade 41 is thus positioned to tape insertion path 21.

In this case, positioning pin 37 is positioned on the center line of tape insertion path 21, and stopper surface 36*a* of stopper 36 extends symmetrically to said center line perpendicular to tape insertion path 21. As a result, when a narrow tape Tb is inserted, the end of tape Tb will contact stopper 36, and the insertion position of the end of this tape Tb will be reliably controlled. The tape T inserted to tape insertion path 21 is thus positioned by stopper 36 and side walls 32.

Figure 3:
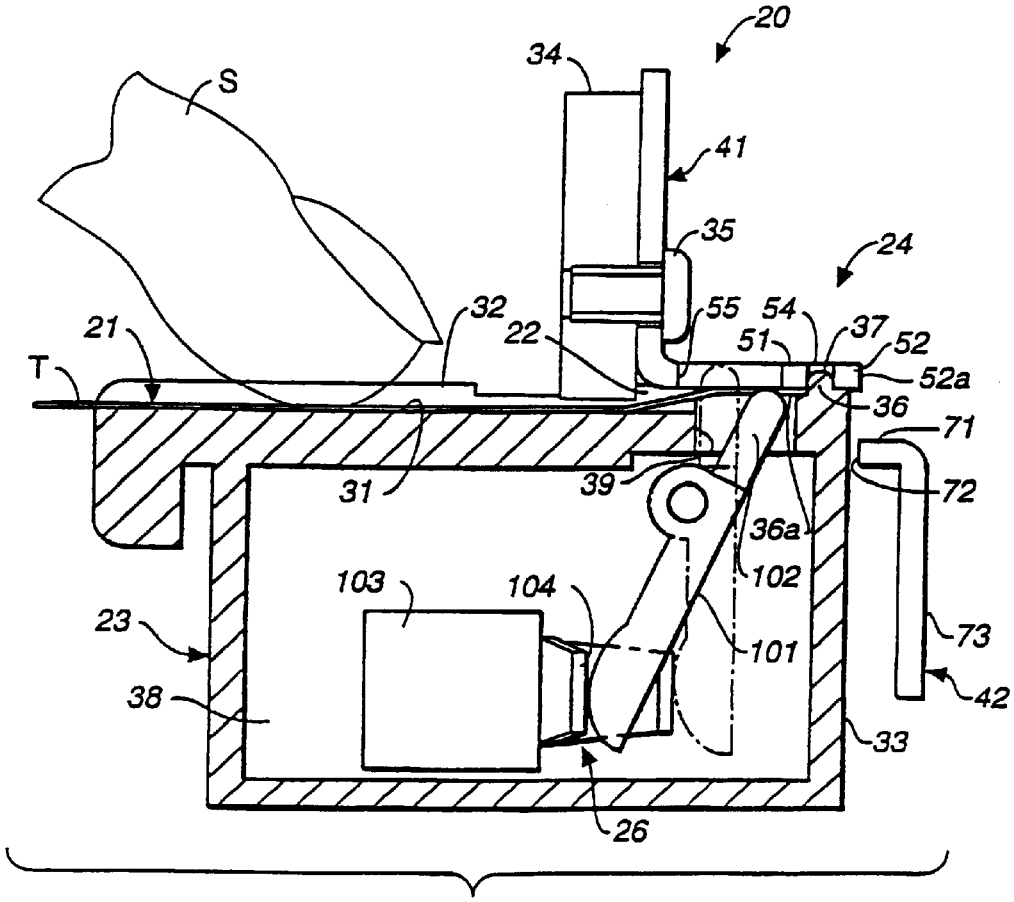
FIG. 3 is a cross-sectional view of the tape end trimming apparatus according to the first embodiment of the present invention taken along line A—A in FIG. 2.

In addition, as shown in FIG. 3, passage surface 31 of tape insertion path 21 rises slightly near stopper 36. As described above, blade 51 of fixed blade 41 is disposed in opposition to passage surface 31. In addition, the gap between passage surface 31 and blade 51 is large at the outside and gradually narrows at the inside in the insertion direction. In other words, there is a sufficiently large gap in the area of tape insertion opening 22 while the gap at the inside end of tape insertion path 21 is only slightly greater than the thickness of the tape T. This makes it easy to insert the tape T to the tape insertion path 21, and depresses the tape T to hold it flat as the tape T is inserted to stopper 36.

Referring back to FIG. 2, cutting blade 24 comprises fixed blade 41, moving blade 42, and stud 43 linking fixed blade 41 and moving blade 42, thus forming a scissors-like construction for cutting the tape T by a scissors action. Moving blade 42 pivots on stud 43, crossing while contacting fixed blade 41 from the bottom up to cut tape T. Fixed blade 41 has an L-shaped cross section comprising blade 51 forming cutting edge 52, and blade holder 53 joined to blade 51. Fixed blade 41 is fixed to guide means 23 by blade holder 53. In this case, fixed blade 41 is produced by, for example, stamping and then bending a stainless steel sheet, heat treating (hardening) the blade, and then grinding or polishing the cutting edge 52.

Continuous cutting edge 52 is formed at the leading edge of blade 51, a positioning hole 54 for engaging with positioning pin 37 is formed at the middle of the leading edge, and a pair of oval holes 55 opposed to detecting ends 102 of detection means 26 is formed inset from said leading edge. Cutting edge 52 is formed perpendicular to both front and back sides of blade 51, i.e., parallel to the cutting direction (FIG. 3). More specifically, the perpendicularly-ground leading edge of blade 51 is cutting edge 52, and the corner where this leading edge and the back of blade 51 intersect forms edge 52*a* of cutting edge 52.

Figure 4:
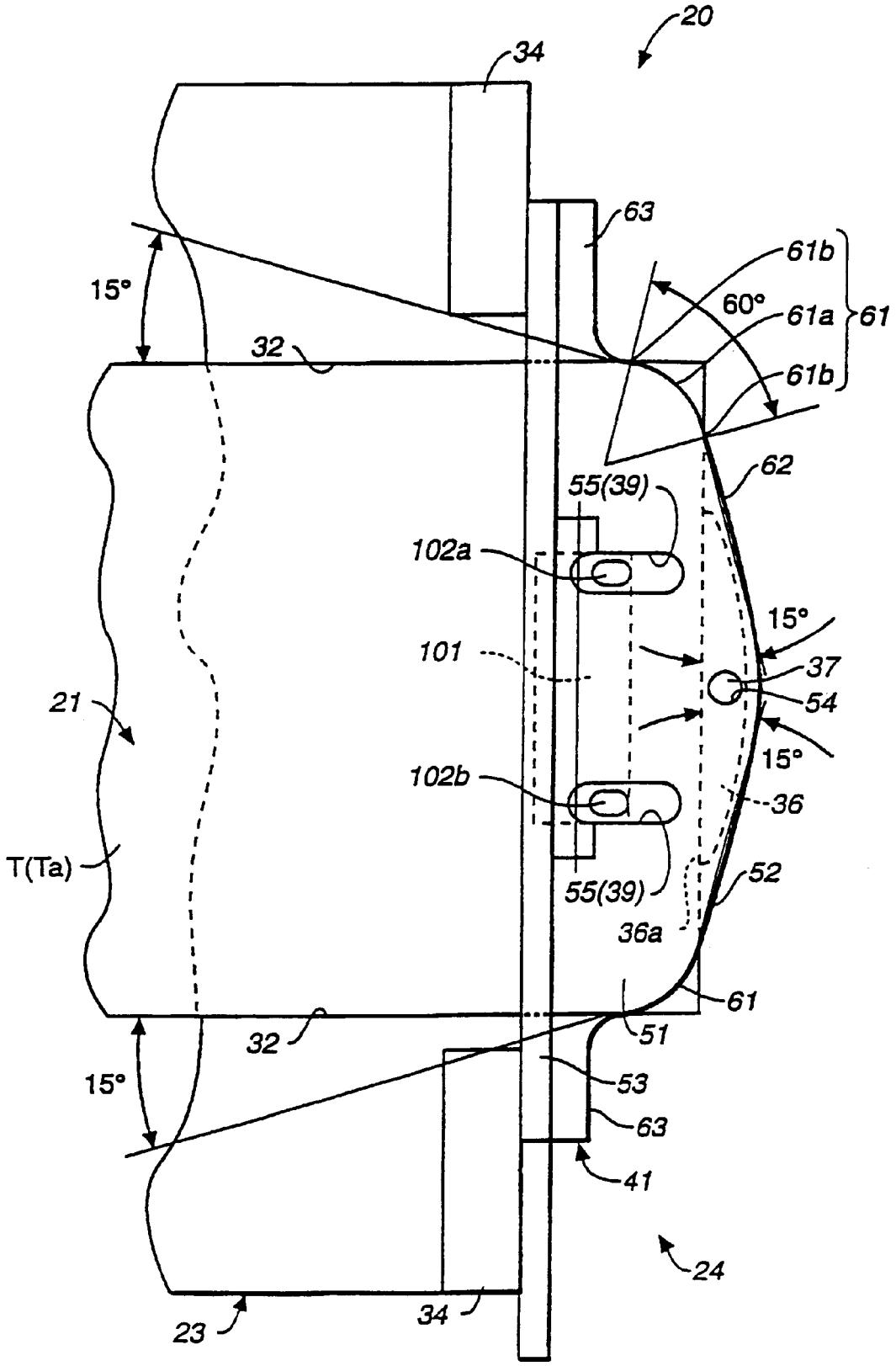
FIG. 4 is a plan view in the vicinity of a fixed blade in the tape end trimming apparatus in accordance with the first embodiment of the present invention.

As shown in FIG. 4, cutting edge 52 comprises right and left curved blade members 61 at the place where the corners of tape T are cut, first guide blade member 62 joining the two curved blade members 61, and right and left second guide blade members 63 extending to the outside from the corresponding curved blade members 61.

The plane shape that is the shape of edge 52*a* of curved blade members 61 comprises curved members 61*a* having a central angle of sixty degrees, and straight members 61*b* extending from both ends of curved members 61*a* tangentially to the curve. The radius of curved members 61*a* in this embodiment is preferably 3 mm. The angle between the side of the cut tape T and the corresponding straight member 61*b* is thus fifteen degrees, and the angle between the end (leading edge) of tape T and the other straight member 61*b* is also fifteen degrees. By thus defining the central angle of curved members 61*a* as less than ninety degrees, the corners of the tape T can be cut to a visually appealing curved shape even when the tape T is not precisely positioned to the cutting blade. It is to be noted that for the curved members to be visually appealing, the central angle of curved members 61*a* shall preferably be set between fifty degrees and seventy degrees, inclusive.

The plane shape of first guide blade member 62 is an arc following the leading edge of the arc-shaped stopper 36 and leading to the corresponding inside ends of curved blade members 61. The plane shape of each second guide blade member 63 leads from one end thereof to straight member 61*b* of curved blade member 61, and curves to a right angle perpendicular to tape insertion path 21.

Referring back to FIG. 2, moving blade 42 similarly has an L-shaped cross section comprising blade 71 forming cutting edge 72, and blade holder 73 joined to blade 71. Moving blade 42 is fixed to stud 43 by blade holder 73 in a manner allowing moving blade 42 to pivot freely thereon. Moving blade 42 is also produced by stamping and then bending a stainless steel sheet, but the blade is not heat treated (hardened). As a result, the hardness of fixed blade 41 is greater than the hardness of moving blade 42. The sound of fixed blade 41 and moving blade 42 meshing together is therefore lower, and the cutting sound of the blades is not irritating. In addition, moving blade 42 wears with repeated cutting operations, but very little wear to fixed blade 41 occurs. As a result, there is very little change in the cut shape of tape T, which is positioned to edge 52*a* of fixed blade 41, and the desired curved shape can be maintained. Moreover, because cutting edges 52 and 72 project into the direction of the cutting operation, there is no change in the shape of cutting edges 52 and 72 as wear advances, and the cutting ability of cutting blade 24 does not deteriorate. Furthermore, as fixed blade 41 and moving blade 42 wear and adapt to each other, the meshing sound (cutting noise) decreases. Moreover, it is sufficient to heat treat only the area of cutting edge 52 or only the area of blade 51. In addition, when a carbide steel or hardened stainless steel is used, moving blade 42 may also be normalized.

Cutting edge 72 of moving blade 42 is shaped complementary to cutting edge 52 of fixed blade 41, and is perpendicular to the front and back faces of blade 71, i.e., to the direction of the cutting operation, similarly to fixed blade 41. Moving blade 42 is supported in a freely pivoting manner on stud 43 in the middle of the length of blade holder 73 such that the range of rotation is limited by drive apparatus 25. The axial center of stud 43 is positioned above blade 51 of fixed blade 41, and cutting edge 72 of moving blade 42 slides past cutting edge 52 of fixed blade 41 at an angle to the cutting direction. In other words, some part of cutting edge 72 of moving blade 42 is in constant contact with some part of cutting edge 52 of fixed blade 41 throughout the range of rotation, and the tape T is cut by moving the contact point from the stud 43 side forward.

Stud 43 comprises a resin bushing 81 and a caulked pin 82 that functions as the rotational axis of moving blade 42. Fixed blade 41 and moving blade 42 are disposed on opposing sides of bushing 81, and are held together by pin 82 passing through fixed blade 41, moving blade 42, and bushing 81. Moving blade 42 is thus pressed toward fixed blade 41 in this state, or more specifically is pressed against fixed blade 41 via the bushing 81. As a result, a gap does not develop between cutting edge 72 of moving blade 42 and cutting edge 52 of fixed blade 41 even after moving blade 42 has worn noticeably, and a good cutting ability is retained in cutting blade 24.

Drive apparatus 25 comprises drive motor 91, worm gear 93 fastened to output shaft 92 of drive motor 91, worm wheel 94 meshing with worm gear 93, and operating pin 95 projecting from worm wheel 94. Operating pin 95 engages with cut-out slot 74 in moving blade 42. Worm gear 93 and worm wheel 94 reduce the torque and speed of drive motor 91 while also changing the direction of rotation, and cause operating pin 95 to rotate around the rotational axis of worm wheel 94. Operating pin 95 and cut-out slot 74 in moving blade 42 form a positive motion cam causing moving blade 42 to rock by means of operating pin 95 rotating while sliding along cut-out slot 74. In other words, when drive motor 91 is driven, moving blade 42 reciprocates through a certain angle to cut tape T. It is to be noted that the frequency of moving blade 42 reciprocation is preferable set to approximately one second.

Driving drive motor 91 is controlled by control means 27 in accordance with a detection signal input from detection means 26, which detects insertion of tape T to tape insertion path 21.

Referring again to FIG. 3, detection means 26 is located in hollow 38 of guide means 23, and comprises switch arm 101 and detection switch 103. Detecting end 102 of switch arm 101 faces tape insertion path 21, and detection switch 103 contacts the lower end of switch arm 101. Switch arm 101 is further fastened to guide means 23 at the top of the inside hollow 38 in a manner allowing switch arm 101 to rotate freely between a non-detection position and a detection position. In the non-detection position detecting end 102 obstructs tape insertion path 21, and in the detection position is retracted from tape insertion path 21.

Detection switch 103 may be, for example, a microswitch with switch lever 104 thereof in contact with the lower end of switch arm 101 and pushing switch arm 101 toward the non-detection position. Detection switch 103 is thus OFF when switch arm 101 is in the non-detection position, and becomes ON when switch arm 101 is rotated from the non-detection position to the detection position. Detection switch 103 continuously outputs the detection signal when in the ON state.

Detecting end 102 of switch arm 101 splits the top end of switch arm 101 into two parts, forming a pair of detector projections 102*a* and 102*b* each disposed in a direction projecting into tape insertion path 21. The pair of detector projections 102*a* and 102*b* are provided before stopper 36 in the insertion direction, and are exposed through the pair of guide holes 39 formed in guide means 23 to oppose the leading edge of the tape T as it is inserted to tape insertion path 21. The pair of guide holes 39 match the pair of oval holes 55 formed in fixed blade 41, and permit the ends of detector projections 102*a* and 102*b* to enter oval holes 55 as detector projections 102*a* and 102*b* rotate to the non-detection position.

Thus, when tape T is inserted to tape insertion path 21, the leading edge of tape T pushes back on detector projections 102*a* and 102*b*, thus rotating switch arm 101, and contacts stopper 36. As a result, detection switch 103 becomes ON a moment before tape T contacts stopper 36. It is therefore possible to gradually cut the corners of tape T to the desired curved shape. Furthermore, because detecting end 102 of detection means 26 comprises a pair of detector projections 102*a* and 102*b*, it is not necessary to provide a large opening for detecting end 102 in guide means 23 and fixed blade 41, and the mechanical strength of end 33 of guide means 23 and blade 51 of fixed blade 41 is not impaired.

Figure 5:
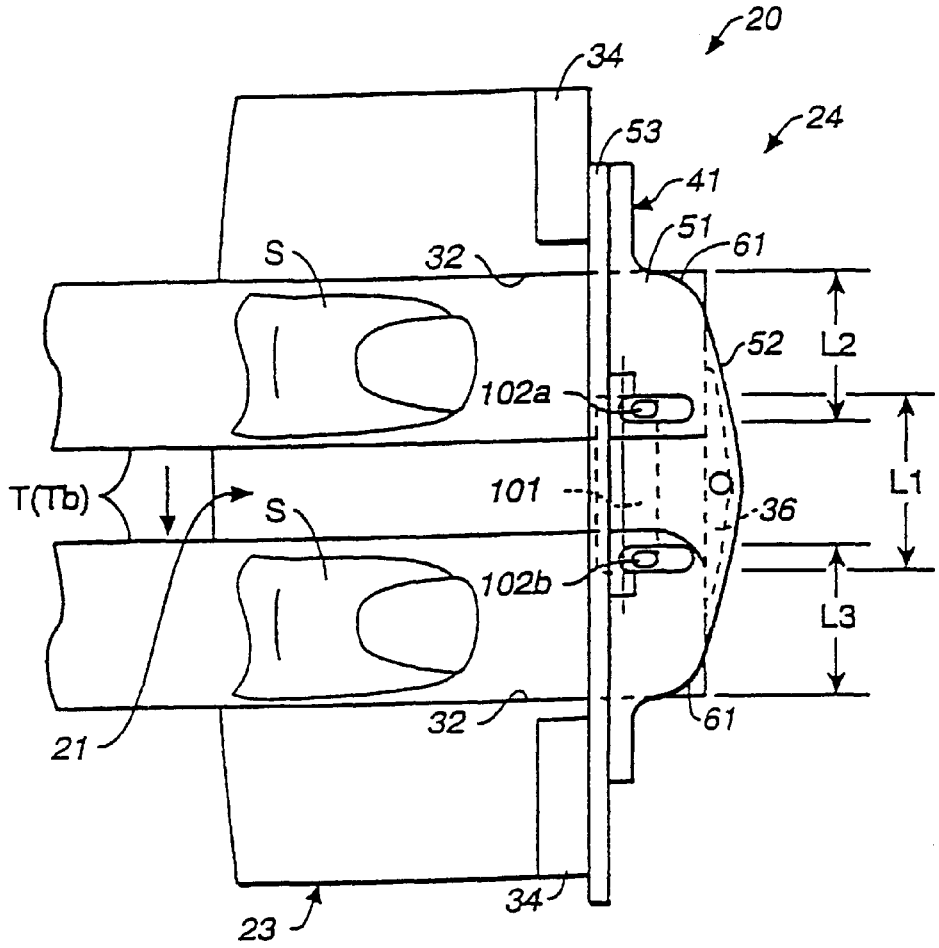
FIG. 5 is a plan view in the vicinity of a tape insertion path in the tape end trimming apparatus in accordance with the first embodiment of the present invention.

If, as shown in FIG. 5, L1 is the distance between the outside edges of both detector projections 102*a* and 102*b*, L2 is the distance between the inside edge of one detector projection 102*a* and the nearest side wall 32, and L3 is the distance between the inside edge of the other detector projection 102*b* and the other side wall 32, the plane positions of the pair of detector projections 102*a* and 102*b* are set such that L2 equals L3, and L1, L2, and L3 are each less than the width of the narrowest usable tape T (9 mm wide in this example). When thus comprised, switch arm 101 will rotate to the detection position and turn detection switch 103 ON irrespective of where in the widthwise direction of tape insertion path 21 tape T is inserted, even if the tape T is of the narrowest usable tape width. In addition, if the inserted tape T is less than the maximum width and is moved horizontally across tape insertion path 21, switch arm 101 will remain in the detection position, and detection switch 103 will remain in the ON state.

It is to be noted that the detection signal is in this embodiment output continuously while detection switch 103 is ON (for a maximum five seconds as described below), and moving blade 42 thus continues the reciprocating action relative to fixed blade 41. For example, when moving blade 42 starts to rotate from a position below fixed blade 41, moving blade 42 slides across fixed blade 41 from below and cuts the corners of tape T. However, when moving blade 42 starts to rotate from a position above fixed blade 41, moving blade 42 bends the corners of tape T as it passes fixed blade 41, and then cuts tape T as it then rotates up. As a result, tape T is reliably cut irrespective of from where moving blade 42 starts to move, i.e., irrespective of where moving blade 42 stops. This means that it is not necessary to control the stop position of moving blade 42.

It is to be noted that a photointerrupter may be used in place of detection switch 103. More specifically, an optical sensor can be used in place of a mechanical switch to detect insertion of tape T to tape insertion path 21. In this case, the structure of detection means 26 can be further simplified.

Figure 6:
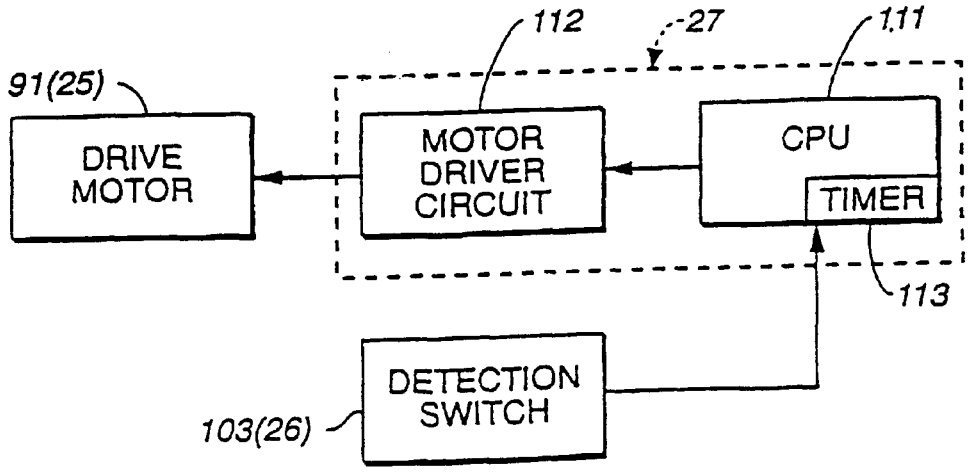
FIG. 6 is a block diagram of a control system of the tape end trimming apparatus in accordance with the first embodiment of the present invention.

Control means 27 comprises CPU 111 and motor drive circuit 112 as shown in FIG. 6. When the detection signal is input from detection switch 103 to CPU 111, CPU 111 controls and drives drive motor 91 through motor drive circuit 112. More specifically, when tape T is inserted to tape insertion path 21, drive motor 91 starts, and when tape T is removed, drive motor 91 stops.

CPU 111 also comprises timer 113 for counting a predetermined period, preferably five seconds in this embodiment, from the start of drive motor 91 operation. When this period elapses, CPU 111 overrides the detection signal from detection switch 103 and stops drive motor 91. This prevents overheating of drive motor 91 if foreign matter becomes trapped, and prevents unnecessary power consumption.

Figure 7:
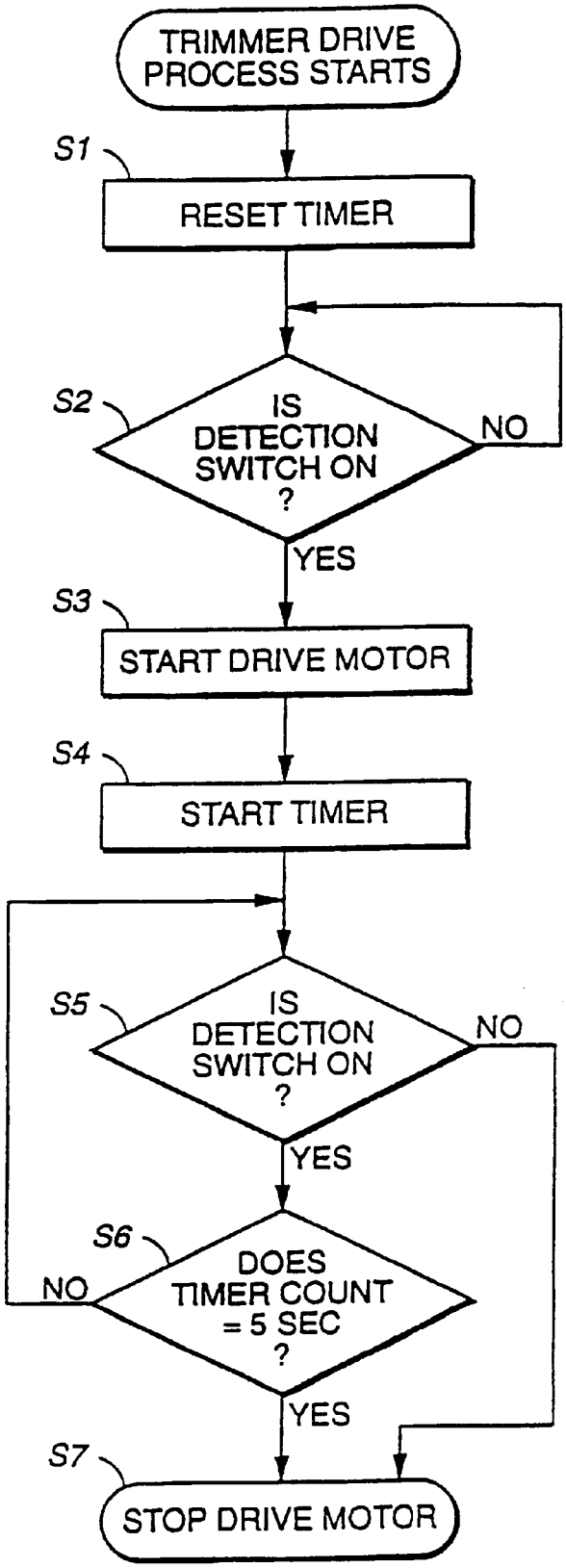
FIG. 7 is a flow chart of the control system of the tape end trimming apparatus in accordance with the first embodiment of the present invention.

The procedure executed by CPU 111 to control drive motor 91 is described below with reference to the flow chart in FIG. 7. The first step (S1) is to reset CPU 111 timer 113 to zero. A determination is then made in step S2 whether tape T is inserted to tape insertion path 21. If the tape T is not inserted, step S2 loops back and CPU 111 thus continuously checks for tape T insertion. When tape T is inserted to tape circuit insertion path 21, CPU 111 starts drive motor 91 by means of motor drive 112 (S3), and in step S4 timer 113 starts counting. It is then determined whether tape T has been removed from tape insertion path 21 in step S5. If tape T has been removed, (step S5 returns NO), drive motor 91 in step is stopped S7. If the tape T has not been not removed (S5=YES) it is determined it step S6 whether five seconds have passed since tape T was inserted. If five second has elapsed (S6=YES) then NO for 91 is also stopped in step S7. Otherwise the procedure returns to step S5.

The operation of tape end trimming apparatus 20 according to the present embodiment of the invention is described briefly below with reference to FIG. 5. Tape T is depressed by finger S as it is inserted to tape insertion path 21 guided by one side wall 32. When tape T is fully inserted to tape insertion path 21, tape T is positioned by said side wall 32 and stopper 36, and one of the leading corners is cut. After confirming that the tape T has been cut based on the sound of cutting, tape T is slid horizontally to the other side wall 32. The tape T is thus positioned by said other side wall 32 and stopper 36, and the other corner is cut. Note that this is the operation used to cut both corners of a tape Tb narrower than the greatest possible tape width Ta. When a tape of the greatest width Ta is fully inserted to tape insertion path 21, it is positioned by both side walls 32 and stopper 36, and both corners are simultaneously cut to shape.

As described above, both corners of tape T can be cut to shape by simply inserting tape T to tape insertion path 21 to cut one corner and then sliding it horizontally to cut the other corner. It is therefore possible to efficiently cut both corners of tapes T of various widths using a single cutting blade 24.

Though not specifically shown in the figures, it is also possible to handle tapes of even greater widths by providing a pair of right and left cutting blades 24. In this case, the reciprocation range of each moving blade 42 can be reduced, and the overall tape end trimming apparatus 20 can be built more compactly.

Second Embodiment

Figure 8:
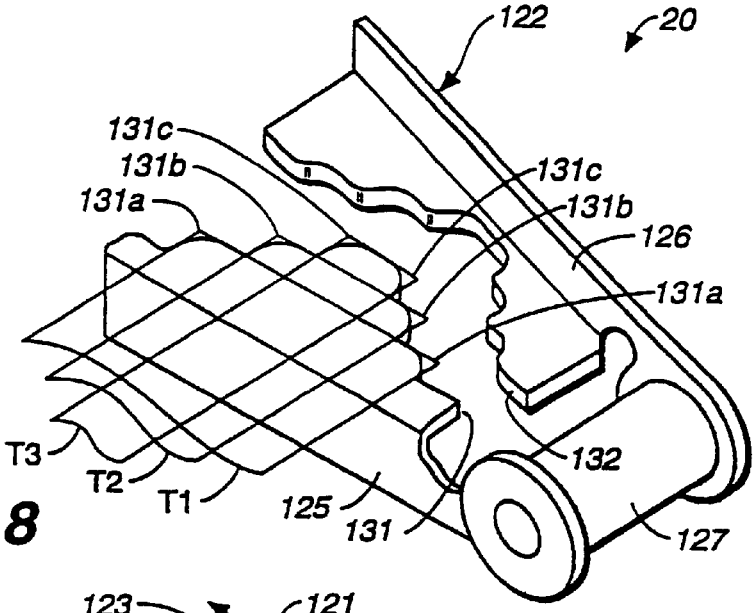
FIG. 8 is an overview of the cutting blade in a tape end trimming apparatus in accordance with a second embodiment of the present invention.
Figure 9:
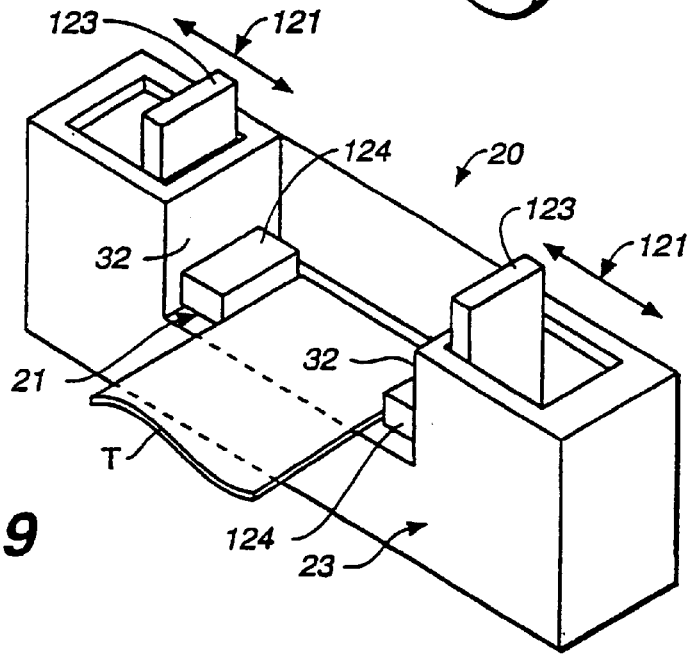
FIG. 9 is an overview in the vicinity of a tape insertion path in a tape end trimming apparatus in accordance with the second embodiment of the present invention.

A second embodiment of a tape end trimming apparatus according to the present invention is described below with reference to FIGS. 8 and 9. In this second embodiment, a path width adjusting mechanism 121, as shown in FIG. 9, for adjusting the width of tape insertion path 21 is built in to guide means 23, and cutting blade 122, as shown in FIG. 8, is shaped to be able to simultaneously cut both leading edge corners of tapes T of various widths.

Path width adjusting mechanism 121 comprises a pair of right and left adjustment tabs 123, a matching pair of right and left moving blocks 124 moving in conjunction with adjustment tabs 123, and an internal linkage mechanism (not shown in the figures) connecting the two moving blocks 124 to each other. Each adjustment tab 123 projects above the top of guide means 23, and is disposed in guide means 23 in a manner permitting both adjustment tabs 123 to slide freely therein. The base ends of adjustment tabs 123 are fastened to the corresponding moving blocks 124, and the exposed ends of moving blocks 124 move into and out of tape insertion path 21 through openings formed in side walls 32 to effectively adjust the width of tape insertion path 21.

The internal linkage mechanism is, for example, an X-shaped linkage of which the ends are engaged with moving blocks 124, thus linking the movement of moving blocks 124 operated by adjustment tabs 123 such that both moving blocks 124 simultaneously move into or retract from the insertion path. As a result, the path width adjusted by the right and left moving blocks 124 is changed relative to the center line of tape insertion path 21.

Cutting blade 122 comprises fixed blade 125, moving blade 126, and stud 127 similarly to the cutting blade of the first embodiment. Cutting edge 131, however, is symmetrically shaped in stages corresponding to plural tapes T of different widths. In the example shown in FIG. 8, cutting edge 131 is formed for tapes T of three possible widths, and comprises right and left first cutting edges 131*a* for cutting both corners of tape T1 of the greatest possible width, right and left second cutting edges 131*b* for cutting both corners of tape T2 of an intermediate width, and right and left third cutting edges 131*c* for cutting both corners of tape T3 of the narrowest width. Cutting edges 131*a,* 131*b,* and 131*c* are formed in this example in sequential stages bulging out towards the center as shown in FIG. 8. Of course, as will be appreciated by one of ordinary skill in the art, while in this example three different widths were shown, other numbers of widths are also contemplated.

Cutting edge 132 of moving blade 126 is shaped complementary to cutting edge 131 of fixed blade 125. Moving blade 126 and fixed blade 125 are furthermore disposed with the center line of cutting edge 131 of fixed blade 125 and the center line of cutting edge 132 of moving blade 126 is aligned with the center line of tape insertion path 21.

While not shown in the figures, a regulated position adjusting mechanism for controlling the insertion position of the tape T according to the tape width is also provided in guide means 23 facing tape insertion path 21. This regulated position adjusting mechanism positions the tape T1 of the greatest width to first cutting edges 131*a* of fixed blade 125, positions tape T2 of the intermediate width to second cutting edges 131*b,* and positions tape T3 of the narrowest width to third cutting edges 131*c*. It is to be noted that the regulated position adjusting mechanism preferably comprises a stopper or similar member projecting into tape insertion path 21 and moving in conjunction with the movement of moving blocks 124.

It is therefore possible by means of the tape end trimming apparatus in accordance with this second embodiment to cut and shape both corners of tapes T of different widths using a single cutting blade 122 and with a single cutting operation.

Third and Fourth Embodiments

The third and fourth embodiments of the present invention are described below with reference to FIGS. 10A, 10B, 11A and 11B. The cutting blades and regulated position adjusting mechanisms of these embodiments are identical to those of the second embodiment described above, and the following description is therefore limited to the structures of the insertion paths, which differ from that of the second embodiment.

Figure 10A:
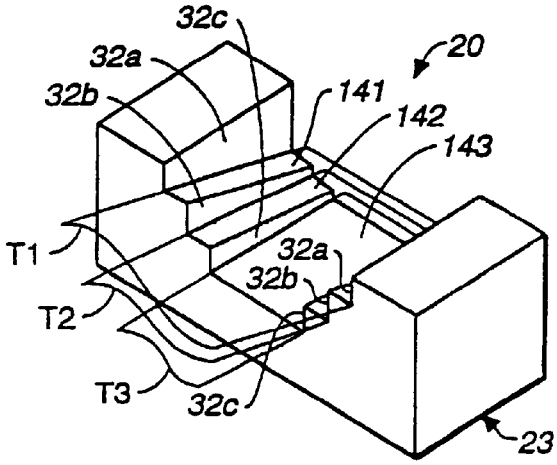
FIG. 10A is an overview and FIG. 10B is a cross-sectional view in the vicinity of the tape insertion path in a tape end trimming apparatus in accordance with a third embodiment of the present invention.
Figure 10B:
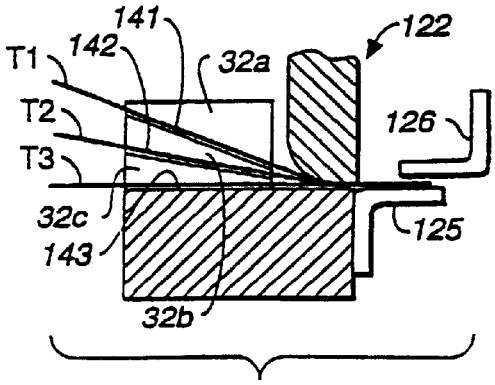

In the third embodiment shown in FIG. 10A, the right and left side walls 32 of guide means 23 are formed in steps descending toward the inside of the insertion path, thus forming at the top step a pair of side walls 32*a* forming a first tape insertion path 141 for a tape T1 of the greatest width, forming at the middle step a pair of side walls 32*b* forming a second tape insertion path 142 for a tape T2 of intermediate width, and forming at the bottom step a pair of side walls 32*c* forming a third tape insertion path 143 for a tape T3 of the narrowest width. As shown in FIG. 10B, first tape insertion path 141, second tape insertion path 142, and third tape insertion path 143 slope towards fixed blade 125 so that the leading edge of the tape T will be appropriately directed to cutting blade 122 by the corresponding tape insertion path 141, 142, or 143.

Figure 11A:
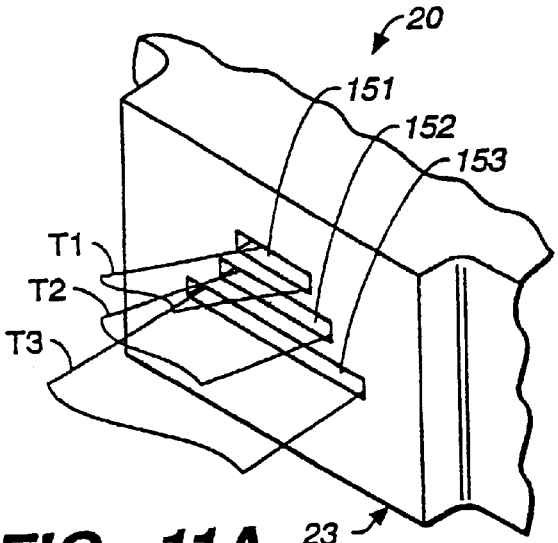
FIG. 11A is an overview and FIG. 11B is a cross-sectional area in the vicinity of a tape insertion path in a tape end trimming apparatus in accordance with a fourth embodiment of the present invention.
Figure 11B:
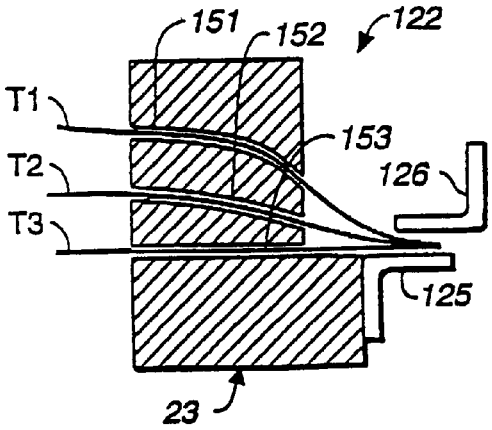

In the fourth embodiment shown in FIG. 11A, a first tape insertion path 151 for the narrowest tape T3 is formed as the top slot in the face of guide means 23, second tape insertion path 152 for tape T2 of an intermediate width is formed as the middle slot, and third tape insertion path 153 for tape T3 of the greatest width is formed as the bottom slot in guide means 23. Referring now to FIG. 11B, the first, second, and third tape insertion paths 151 and 152 curve as they extend toward fixed blade 125.

With the third and fourth embodiments of the tape end trimming apparatus according to the present invention thus described, it is possible to cut and shape both corners of tapes T of different widths using a single cutting blade 122 and with a single cutting operation without it being necessary to adjust the insertion path width.

Fifth Embodiment

Figure 12:
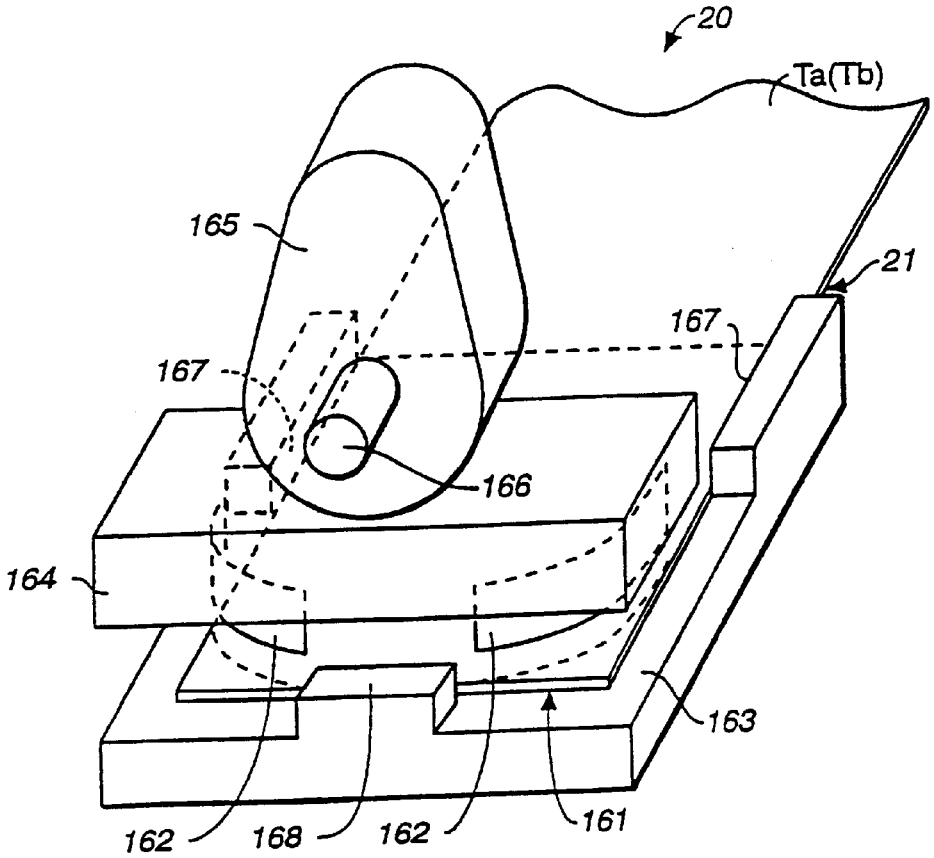
FIG. 12 is a perspective view of a tape end trimming apparatus in accordance with a fifth embodiment of the present invention.

The fifth embodiment of the invention is described next with reference to FIG. 12. In this embodiment, cutting blade 161 comprises a pair of right and left presser blades 162, and cutter bar 163 against which presser blades 162 press. Each presser blade 162 has a curved cutting edge similar to curved blade members 61 of the first embodiment, and is fastened to the bottom of block-shaped cutter holder 164. Cutter holder 164 is pushed upward by a spring or other means, and is supported by a guide member allowing cutter holder 164 to move vertically (note that neither spring nor guide member is shown). Plate cam 165 contacts the top of cutter holder 164, and cam shaft 166 of plate cam 165 is connected to a motor (not shown in the figure). When the motor drives plate cam 165, drive cutter holder 164 moves down against the force of the spring. When cutter holder 164 moves down, presser blade 162 presses against and cuts the corners of tape T positioned on cutter bar 163, thus shaping the corners.

Cutter bar 163 is also provided as an extension of tape insertion path 21, and thus also functions as part of tape insertion path 21. Cutter bar 163 also comprises right and left side walls 167 and end stopper wall 168, which position tape Ta of the greatest usable width and enable both corners thereof to be cut at the same time. A tape Tb (not shown in the figure) narrower than tape Ta is positioned by one side wall 167 and stopper wall 168 to cut one corner, and is then positioned by the other side wall 167 and stopper wall 168 to cut the other corner. It is to be noted that a rubber pad or similar member may also be provided on the top of cutter bar 163.

While the cutting resistance of the cutting means of this fifth embodiment is greater than that of the first embodiment above, the structure of cutting blade 161 is also simpler. Furthermore, if the position of cam shaft 166 of plate cam 165 can be adjusted up and down, it is also possible to cut only the adhesive-backed film part of a tape T backed by a backing paper, thereby both shaping the tape T as desired and facilitating removal of the backing paper.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

| Reference Numerals | |
|---|---|
| 1 | tape printer |
| 20 | tape end trimming apparatus |
| 21 | tape insertion path |
| 23 | guide means |
| 24 | cutting blade |
| 25 | drive apparatus |
| 26 | detection means |

-continued

| Reference Numerals | |
|---|---|
| 27 | control means |
| 31 | passage surface |
| 32 | side walls |
| 36 | stopper |
| 41 | fixed blade |
| 42 | moving blade |
| 43 | stud |
| 51 | blade |
| 52 | cutting edge |
| 52a | edge |
| 61a | curved members |
| 61b | straight members |
| 71 | blade |
| 91 | drive motor |
| 101 | switch arm |
| 102 | detecting end |
| 102a, 102b | detector projections |
| 103 | detection switch |
| 111 | CPU |
| 113 | timer |
| 121 | path width adjusting mechanism |
| 122 | cutting blade |
| 141, 151 | first tape insertion path |
| 142, 152 | second tape insertion path |
| 143, 153 | third tape insertion path |
| 161 | cutting blade |
| 162 | pressure blade |
| 163 | cutter bar |
| T | tape |

What is claimed is:

1. A tape end trimming apparatus for trimming an end of a tape having first and second longitudinal sides and an end side which meets the first longitudinal side to form a first corner and meets the second longitudinal side to form a second corner, the apparatus comprising:

first and second cutting edges for cutting the first and second corners of the tape respectively to a predetermined shape;

a guide structure disposed in proximity to said cutting edges and defining a tape insertion path for guiding the tape to said cutting edges, the guide structure having first and second side guards respectively defining first and second side boundary lines of the insertion path, the first and second side boundary lines being separated by a predetermined width; and an end position regulating structure for regulating an end position of the tape inserted into said insertion path, the end position regulating structure defining an end line and preventing the end side of the inserted tape from passing the end line, wherein the first cutting edge defines a first cut line that intersects the first side boundary line and the end line, and the second cutting edge defines a second cut line that intersects the second side boundary line and the end line.

2. A tape end trimming apparatus according to claim 1 further comprising a fixed blade and a moving blade for trimming the tape by movement of said moving blade relative to said fixed blade, wherein each of said fixed blade and said moving blade comprises a flat blade element and a flat blade holder perpendicular to, and integral with, said flat blade element, wherein the flat blade element of one of the fixed blade and the moving blade includes the first and second cutting edges, and the flat blade of the other one of the fixed blade and the moving blade includes two cutting edges cooperating with the first and second cutting edges to trim the corners of the tape.

3. A tape end trimming apparatus according to claim 2, wherein said fixed blade is disposed on a passage surface of said insertion path with a gap between said fixed blade and said passage surface allowing insertion of the tape.

4. A tape end trimming apparatus according to claim 2, wherein said fixed and moving blades cut the first and second corners by rotating said moving blade relative to said fixed blade.

5. A tape end trimming apparatus according to claim 4, further comprising a shaft member supporting said moving blade in a freely rotating manner, and wherein said shaft member is fixed to said fixed blade.

6. A tape end trimming apparatus according to claim 2, wherein said cutting edges of said moving blade contacts said cutting edges of said fixed blade at an angle to a cutting direction when cutting the tape.

7. A tape end trimming apparatus according to claim 2, wherein the cutting edges of the fixed blade is greater than a hardness of the cutting edges of the moving blade.

8. A tape end trimming apparatus according to claim 2, wherein the cooperating cutting edges of said fixed and moving blades are in complete mutual contact at some point through a rotating range of said moving blade, and wherein said moving blade is pressed against said fixed blade.

9. A tape end trimming apparatus according to claim 2, further comprises a drive apparatus for driving said moving blade.

10. A tape end trimming apparatus according to claim 9, further comprising:

detection means for detecting insertion of the tape into said insertion path, and control means for driving said drive apparatus in response to detection by said detection means of insertion of the tape into said insertion path.

11. A tape end trimming apparatus according to claim 10, wherein said detection means is positioned ahead of said end position regulating structure in a direction of insertion of a tape into said insertion path.

12. A tape end trimming apparatus according to claim 10, wherein said detection means continuously detects whether the tape is inserted into said insertion path.

13. A tape end trimming apparatus according to claim 12, wherein said control means comprises a timer for timing a duration of a detection signal in response to said detection means, and wherein said control means are effective to stop said drive apparatus when the duration of the detection signal exceeds a predetermined period of time.

14. A tape end trimming apparatus according to claim 10, wherein said detection means comprises a mechanically operating detection switch having a detector end projecting into said insertion path.

15. A tape end trimming apparatus according to claim 14, wherein:

said detection switch comprises:

a switch arm having a first end for rotating freely between a non-detection position whereat said detecting end of said switch arm projects into said insertion path, and a detection position whereat said detecting end is retracted from said insertion path; and a switch body in contact with a second end of said switch arm and for being in a first state in a non-detection position and in a second state in a detection position.

16. A tape end trimming apparatus according to claim 15, wherein a tape is movable in an insertion direction along said insertion path and the first end of said switch arm comprises a pair of detector projections, each projecting into said insertion path, and disposed perpendicularly to the insertion direction.

17. A tape end trimming apparatus according to claim 16, wherein the detector projections are provided whereby at least one of said detector projections rotates when a tape having a narrowest width is inserted at any point in a width direction of said insertion path.

18. A tape end trimming apparatus according to claim 1 wherein said first and second cutting edges are curved and are formed on a cutting blade, wherein each cutting edge has a central angle from fifty to seventy degrees, and wherein the cutting blade further comprises two linear extension portions each extending to the outside from and in a direction which is tangential to the end of a respective cutting edge.

19. A tape end trimming apparatus for trimming an end of a tape according to claim 1, wherein the first and the second cutting edges cut the corresponding first and the second corners of the tape independently from each other.

20. A tape printing apparatus incorporating the tape end trimming apparatus of claim 1.

21. A tape end trimming apparatus according to claim 1, wherein the tape insertion path has a floor, the floor having raised portion adjacent the end position regulating structure.

22. A tape end trimming apparatus according to claim 1 wherein a shape of said end position regulating structure conforms to a shape of the first and the second cutting edges.

23. A tape end trimming apparatus according to claim 22 wherein the shape of said end position regulating structure is a crescent.

* * * * *

UNITED STATES PATENT AND TRADEMARK OFFICE

CERTIFICATE OF CORRECTION

PATENT NO : 6,116,129

DATED : September 12, 2000

INVENTOR(S): Masaji Takayama; Kenji Watanabe; Takanobu Kameda; Chieko Aida; Tomoyuki Shimmura It is certified that error appears in the above-identified patent and that said Letters Patent are hereby corrected as shown below:

Col. 1, line 73, add "King Jim Co., Ltd."--.

Signed and Sealed this

First Day of May, 2001

*Attest:*

Nicholas P. Godici

NICHOLAS P. GODICI

*Attesting Officer*

*Acting Director of the United States Patent and Trademark Office*